United States Patent [19]

Fay

[11] Patent Number: 4,660,307

[45] Date of Patent: Apr. 28, 1987

[54] COVER FOR FILM IRONS

[76] Inventor: John W. Fay, 106 Ivy Home Rd., Hampton, Va. 23669

[21] Appl. No.: 870,928

[22] Filed: Jun. 5, 1986

[51] Int. Cl.[4] ..... D06F 83/00

[52] U.S. Cl. ..... 38/94; 150/52 R; 428/76

[58] Field of Search ..... 38/93, 94, 80, 81, 140; 150/52 R, 52 G; 2/2; 428/76

[56] References Cited

U.S. PATENT DOCUMENTS

| | | | |
|---|---|---|---|
| 1,322,821 | 7/1973 | Hargreaves | 38/140 |
| 1,886,464 | 11/1932 | Bright | 150/52 G |
| 2,323,162 | 6/1943 | Talmage | 38/93 |
| 2,464,570 | 3/1949 | Galbraith | 38/140 |
| 3,938,570 | 2/1976 | Stewart | 150/52 G |
| 4,255,817 | 3/1981 | Heim | 2/2 |

*Primary Examiner*—Werner H. Schroeder
*Assistant Examiner*—Andrew M. Falik
*Attorney, Agent, or Firm*—Glenn K. Robbins

[57] ABSTRACT

A cover for a film iron used to iron on films on models such as model airplanes and the like. The cover is of natural fiber cloth to provide a controlled heat transfer and provides a relatively soft surface preventing marring of the film surface. The cover fits over the bottom of the iron and by means of a draw string is tied over sloping sides of the iron and an elongated iron handle. The cover is simply fabricated from two sheets of cloth sewn to provide a peripheral draw string passage and is formed to provide an upstanding rear draw string passage fitting under the handle which facilitates fitting the iron to the cover and tying the draw string over the handle.

5 Claims, 7 Drawing Figures

COVER FOR FILM IRONS

BACKGROUND OF THE INVENTION

In the building of models of one type or another and particularly model airplanes, iron on plastic film coatings have been employed. Such films are provided in different colors and are cut to a proper size and shape and ironed on to an appropriate surface. The film conventionally embodies a bottom heat sensitive surface which is activated by the pressure of the iron when applied to the top surface of the film.

The irons employed in the past use an elongated rear handle for ease in manipulation and have a pointed foot portion at the front for access to differently configured portions of the model. The bottom of the iron is provided with a plastic coating such as teflon which has a slick surface to modify the heat transfer and prevent damage to the surface of the iron on film.

While the teflon coating represents an improvement over the bottom steel surface of the iron, there has been a problem in use of scratches or other breaks in the surface of the teflon appearing. Such scratches tend to cause scratches or marks and other irregularities in the surface of the iron on coating and damage to the appearance.

SUMMARY OF THE INVENTION

Through this invention there has been provided a fabric cover that may be simply secured to the bottom of irons employed iron on plastic film for model airplanes and the like.

The cover is contoured to the bottom of the iron and simply fits over the sloping sides and by means of a draw string is easily secured to the rearwardly extending handle. The cover is comprised of a natural fiber such as cotton which is not affected by the moderate temperature of the iron and furnishes an even distribution of heat while providing a soft smooth surface which does not transmit any of the usual scratches or other surface defects found in teflon coated irons or irons with a steel bottom or other hard surface subject to scratches and the like which occur after substantial iron usage, accidental scratching or the like.

The cover is generally contoured to the bottom configuration of the iron and is provided with a draw string fitting in a channel seam or guide extending around overlapping edges of the cover. The ends of the draw string are positioned at the rear of the cover underneath the iron handle and are simply pulled tight to fit the cover over the sloping sides of the iron and tied over the handle to secure firmly the cover to the iron.

The fabric cover when fitted over the iron further serves to protect the bottom surface of the iron from protection against accidental knocks by foreign objects. In addition, accidental touching contact of the bottom of the iron with the skin of the user does not transmit the heat of the iron so rapidly as to harm the user.

In use the fabric cover when light pressure is applied transmits the heat of the iron in an evenly controlled fashion and the iron on film coating is applied in an efficient manner. Any minor scratches or imperfections are not transmitted to the film and in effect the cover serves as a buffer.

The cover is simply fabricated from two sheets of cotton fabric or the like to form a two ply cover. The seam channel or guide for the fabric is first formed around the periphery of the cover which is then pulled inside out to conceal the seam channel. The rear of the cover is then folded at the corners and stretched to provide an upstanding rear seam channel for the draw string underneath the iron handle. This facilitates the positioning of the ends of the draw string when interfitted in the seam channel for ready tying and securing to the handle.

The fabric cover of this invention is simply and inexpensively fabricated for ready usage by model builders. No particular skill or tools are required for attachment to the iron. Its employment with the iron serves to prolong the life of the iron, both in preventing scratches to the bottom surface and providing for long usage after scratches or marring of the iron surface do occur.

The above features are objects of this invention. Further objects will appear in the detailed description which follows and will be further apparent to those skilled in the art.

For the purpose of illustration of this invention, preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
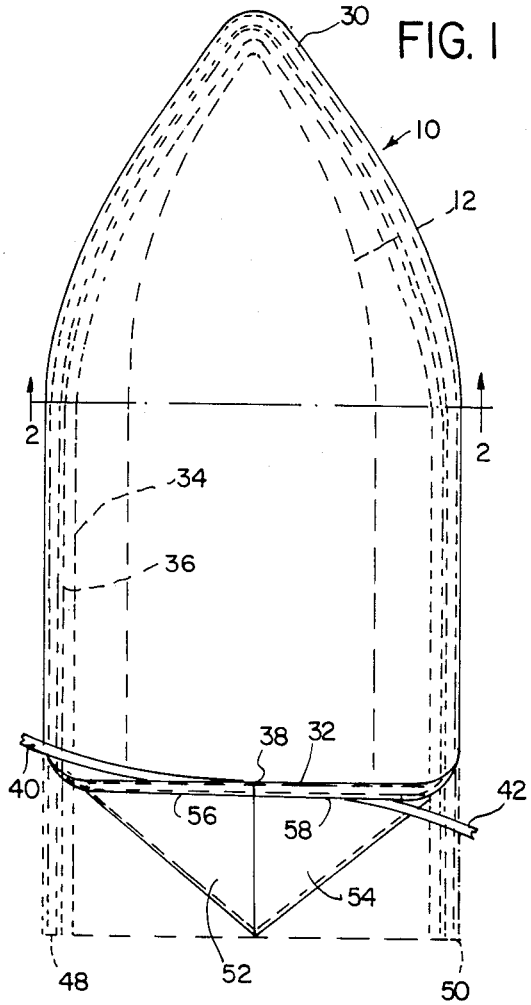
FIG. 1 is a top plan view of the iron cover before final stitching.
Figure 6:
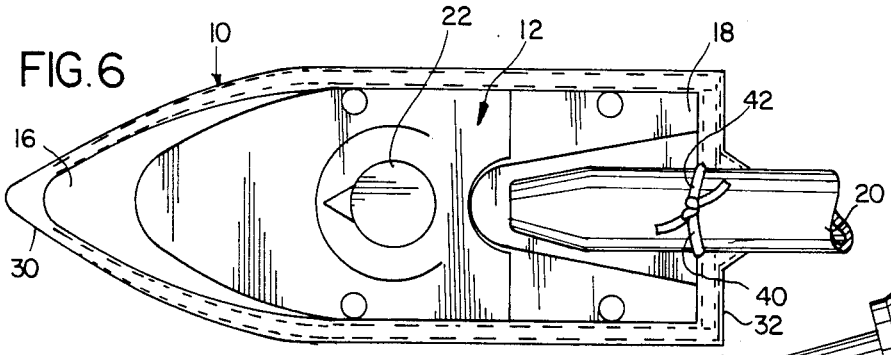
FIG. 6 is a top plan view showing the cover attached to an iron.
Figure 7:
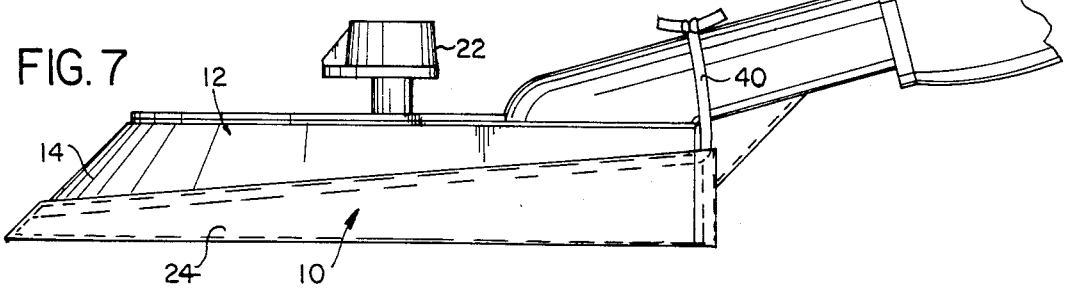
FIG. 7 is a view similar to FIG. 6 in side elevation taken from the left side of FIG. 6.

The iron cover of this invention is generally indicated by the reference numeral 10 in FIGS. 1, 6 and 7. It is shown in FIGS. 6 and 7 secured to a conventional iron 12 employed with iron on films utilized in the model building field.

The iron has sloping sides 14 and a pointed foot portion 16 at the front with a squared rear end 18. A handle 20 extends to the rear. A control knob 22 serves to control the operating temperature of the iron. The bottom 24 of the iron and a lower portion of the sloping sides is conventionally coated with teflon or the like.

Figure 2:
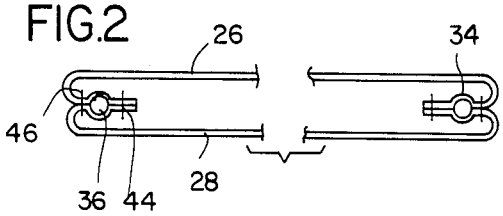
FIG. 2 is an interrupted view in section taken on the line 2—2 of FIG. 1.

The cover 10 is of a two ply sheet construction formed of a top ply 26 and a bottom ply 28 as shown in FIG. 2. The cover lays substantially flat and has the general configuration of the bottom of the iron but is slightly larger and overlaps the sides of the iron which may be positioned on top of the cover as shown in FIG. 1 in dotted line.

The cover has a pointed forward front portion 30 and a square rear end 32 generally contoured to the bottom 24 of the iron. A seam channel 34 is stitched around the periphery of the cover internally and is protected and concealed inside the two cover plies 26 and 28. The seam channel serves as a guide for a draw string 36 which fits within the channel and extends through a rear opening 38 to expose ends 40 and 42 of the draw string.

Figure 4:
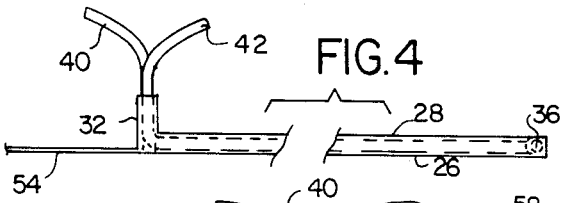
FIG. 4 is an interrupted view in elevation taken from the right side of FIG. 1.
Figure 5:
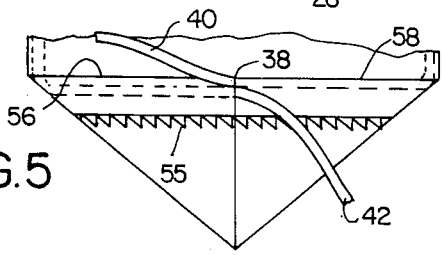
FIG. 5 is fragmentary top plan view of the rear end of the completed cover showing after final stitching.

The squared rear end 32 of the cover as shown in FIG. 4 extends upwardly. This configuration aids in presenting the ends of the draw string underneath the handle and provides easy access to the free ends.

Figure 3:
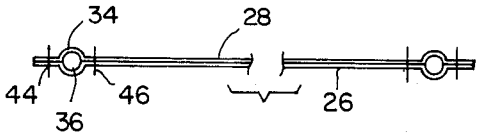
FIG. 3 is an interrupted view in section showing a stage in the manufacture.

The fabrication of the cover is simply effected by laying the two plies 26 and 28 flat in the position shown in FIG. 3 and forming the seam channel 34 around the draw string 36 by stitches 44 and 46. Alternatively, the draw string may be inserted after formation of the cover as desired.

After the seam channel has been formed, the cover may be pulled inside out to the form shown in FIG. 2. This construction protects and conceals the seam channel 34 and draw string 36.

After the preliminary fabrication stage aforementioned, the cover is laid flat in the dotted line position shown in FIG. 1 and the corners 48 and 50 are turned inwardly to form the folded over triangular end portions 52 and 54. A stitch 55 is formed at the rear of the turned up rear seam channel end portions 56 and 58 which holds them adjacent to one another and erect. The triangular end portions may be cut off as desired.

USE

The cover 10 of this invention is very simply fitted over the iron 12. The cover is laid flat and the iron is placed over it in the dotted line position 12 as shown.

The overlapping edges of the cover are then pulled up over the sloping sides of the iron by drawing on both ends 40 and 42 of the draw string 36. The draw string is then tied over the iron handle 20 as shown in FIGS. 6 and 7.

After the cover has been secured, the iron is used in the conventional fashion to affix the iron on film coating selected by the user to the model airplane or other type of model as desired. The cover provides an improved heat transfer control while preventing damage by any scratches or other surface imperfections on the bottom of the iron. After use the cover may be left on to provide protection to the bottom surface of the iron or removed. Replacement due to wear of the cover is effected simply and at modest cost.

Various changes and modifications may be made within this invention as will be apparent to those skilled in the art. Such changes and modifications are within the scope and teaching of this invention as defined in the claims appended hereto.

What is claimed is:

1. A fabric cover for the bottom surface of an iron having a pointed front foot and an elongated rear handle, said cover comprising a fabric sheet-like member having a congruent configuration to and overlapping the bottom of the iron when placed thereon, a draw string passing through a channel seam extending around the periphery of the sheet-like member, said draw string having opposite free ends extending through an opening in the channel seam and of a length sufficient to be tied together to pull said seam over sides of said iron and connect the cover securely to the bottom and around the lower sides of the iron, said opening in the channel seam being underneath the handle and the ends of the draw string being of a sufficient length to be tied over the handle of the iron and the channel seam being squared at a rear end of the cover to be congruent with a squared rear end of the iron and said channel seam extending upwardly from the cover underneath the handle and closely adjacent thereto to provide ready access to the user of the free ends of the draw string and facilitate tying to the handle.

2. A fabric cover for the bottom surface of an iron having a pointed front foot and an elongated rear handle, said cover comprising a fabric sheet-like member having a congruent configuration to and overlapping the bottom of the iron when placed thereon, a draw string passing through a channel seam extending around the periphery of the sheet-like member, said draw string having opposite free ends extending through an opening in the channel seam and of a length sufficient to be tied together to pull said seam over sides of said iron and connect the cover securely to the bottom and around the lower sides of the iron, the fabric being comprised of two separate plies and said channel seam and draw string being positioned in the interior of the cover between said plies to conceal and protect the channel seam and draw string.

3. The cover of claim 2 in which the cover is fabricated by stitching spaced stitches about the periphery of the exterior of said two plies to form said channel seam to receive said draw string, pulling the plies inside out to conceal the two stitches and so-formed channel seam.

4. The cover of claim 3 in which rear corners of the plies are folded together adjacent a squared rear end of the channel seam and stitched together to reinforce the rear end of the channel seam and position it in an upwardly extending direction underneath the rear handle of the iron.

5. A fabric cover for the bottom surface of an iron having a pointed front foot and an elongated rear handle, said cover comprising a fabric sheet-like member having a congruent configuration to and overlapping the bottom of the iron when placed thereon, a draw string passing through a channel seam extending around the periphery of the sheet-like member, said draw string having opposite free ends extending through an opening in the channel seam and of a length sufficient to be tied together to pull said seam over sides of said iron and connect the cover securely to the bottom and around the lower sides of the iron, the channel seam being squared at a rear end of the cover to be congruent with a squared rear end of the iron and said channel seam extends upwardly from the cover underneath the handle and closely adjacent thereto to provide ready access to the user of the free ends of the draw string and facilitate tieing to the handle and the fabric cover is comprised of two separate plies and said channel seam and draw string are positioned in the interior of the cover between said plies to conceal and protect the channel seam and draw string.

* * * * *